US009046311B2

(12) United States Patent
Powers et al.

(10) Patent No.: US 9,046,311 B2
(45) Date of Patent: Jun. 2, 2015

(54) COLLAR RIBS FOR HEAT EXCHANGER HEADERS TANKS

(75) Inventors: Michael Powers, Lakewood, NY (US); Scot Carapellatti, Olean, NY (US); Alan Day, Reims (FR); Philippe Faille, Reims (FR); Michel Guerand, Saint-Soupplets (FR)

(73) Assignee: Valeo, Inc., Auburn Hills, MI (US)

( * ) Notice: Subject to any disclaimer, the term of this patent is extended or adjusted under 35 U.S.C. 154(b) by 946 days.

(21) Appl. No.: 10/582,735

(22) PCT Filed: Dec. 15, 2004

(86) PCT No.: PCT/US2004/042079

§ 371 (c)(1),
(2), (4) Date: Mar. 13, 2007

(87) PCT Pub. No.: WO2005/066568

PCT Pub. Date: Jul. 21, 2005

(65) Prior Publication Data

US 2007/0261835 A1 Nov. 15, 2007

Related U.S. Application Data

(60) Provisional application No. 60/530,957, filed on Dec. 19, 2003.

(51) Int. Cl.

| | |
|---|---|
| ***F28F 9/02*** | (2006.01) |
| ***F28F 9/18*** | (2006.01) |
| *F28D 1/00* | (2006.01) |

(52) U.S. Cl.

CPC ..... *F28F 9/182* (2013.01); *F28F 9/0226* (2013.01)

(58) Field of Classification Search

USPC ..... 165/175, 149; 29/890.052

See application file for complete search history.

(56) References Cited

U.S. PATENT DOCUMENTS

| | | | | | |
|---|---|---|---|---|---|
| 4,023,618 | A | * | 5/1977 | Kun et al. | 165/175 |
| 4,559,688 | A | * | 12/1985 | Abu-Isa et al. | 29/890.052 |
| 4,722,387 | A | * | 2/1988 | Aurand | 165/153 |
| 4,972,615 | A | * | 11/1990 | Grant | 40/641 |
| 5,195,581 | A | * | 3/1993 | Puntambekar et al. | 165/173 |
| 5,201,368 | A | * | 4/1993 | Kroetsch | 165/173 |
| 5,228,512 | A | * | 7/1993 | Bretl et al. | 165/153 |
| 5,758,721 | A | * | 6/1998 | Letrange et al. | 165/173 |
| 5,873,409 | A | * | 2/1999 | Letrange et al. | 165/173 |
| 5,894,649 | A | * | 4/1999 | Lambert et al. | 29/890.052 |
| 5,899,267 | A | * | 5/1999 | Kroetsch et al. | 165/173 |
| 5,947,196 | A | * | 9/1999 | Halm et al. | 165/173 |
| 6,035,931 | A | * | 3/2000 | Kado et al. | 165/174 |

(Continued)

FOREIGN PATENT DOCUMENTS

DE 29504526 U1 * 7/1996

*Primary Examiner* — Tho V Duong
*Assistant Examiner* — Aaron Isenstadt
(74) *Attorney, Agent, or Firm* — Dierker & Associates, P.C.

(57) ABSTRACT

The present invention relates to the field of automotive heat exchangers, and, in particular, to heat exchanger tanks with headers. This invention eliminates the need for use of an inner flange on the header using a collar that also acts as a rib, thereby providing a compact foot plus header tank arrangement with lower stress on the gasket mating surface of the header and tank. The present invention also provides a method for providing improved headering means for automotive heat exchangers with plastic tanks and headers.

7 Claims, 10 Drawing Sheets

(56) References Cited

U.S. PATENT DOCUMENTS

| | | | | |
|---|---|---|---|---|
| 6,179,049 | B1 * | 1/2001 | Higgins | 165/140 |
| 6,196,305 | B1 * | 3/2001 | Geiger | 165/149 |
| 6,749,015 | B2 * | 6/2004 | Moreau | 165/174 |
| 7,121,329 | B2 * | 10/2006 | Shields et al. | 165/149 |
| 7,234,511 | B1 * | 6/2007 | Lesage | 165/69 |
| 7,673,672 | B2 * | 3/2010 | Velzy et al. | 165/149 |
| 2003/0217838 | A1 * | 11/2003 | Dey et al. | 165/173 |
| 2005/0133208 | A1 * | 6/2005 | Powers et al. | 165/149 |

* cited by examiner

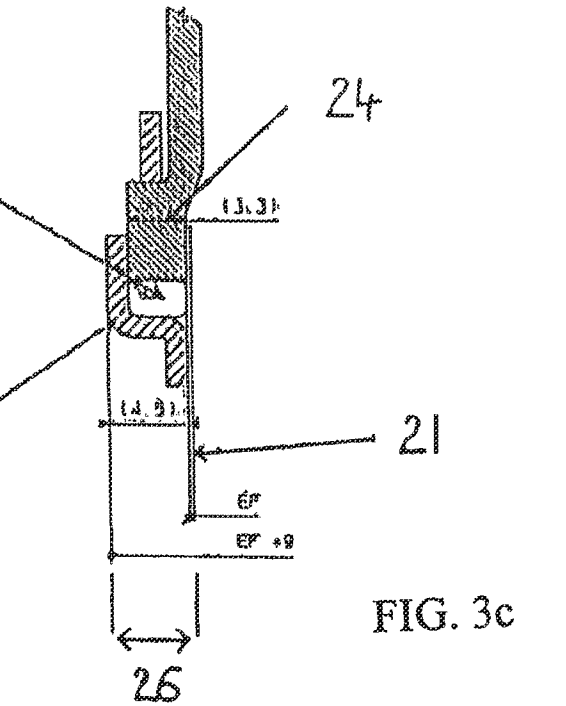
FIG. 3c
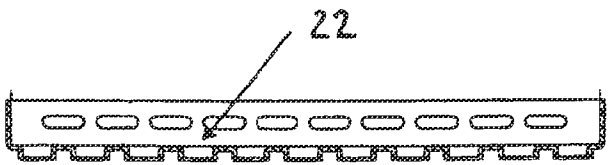
FIG. 3d
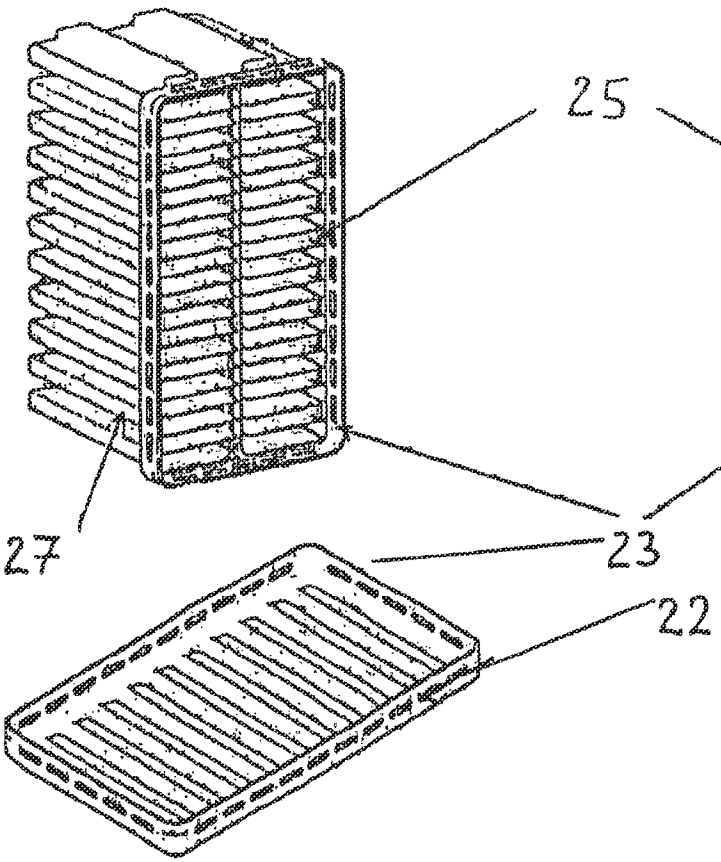
FIG.3a
FIG.3b

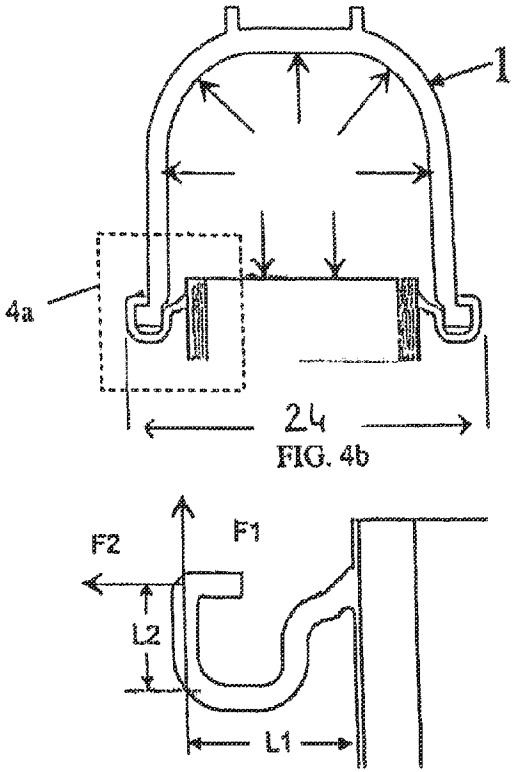
FIG. 4b
FIG. 4c
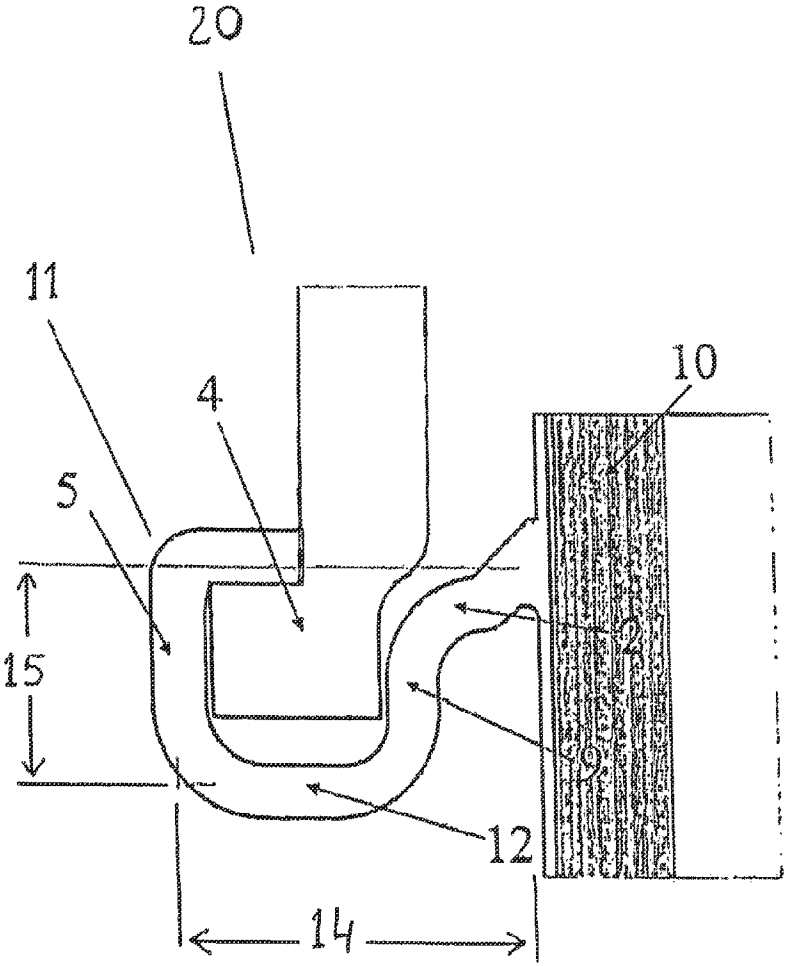
FIG. 4a
Prior Art

COLLAR RIBS FOR HEAT EXCHANGER HEADERS TANKS

CROSS-REFERENCE TO RELATED APPLICATIONS

This application is a 35 U.S.C. § 371 national stage filing of international application serial number PCT/US2004/042079, filed on Dec. 15, 2004, which itself claims the benefit of U.S. Provisional application serial number 60/530,957, filed on Dec. 19, 2003.

FIELD OF THE INVENTION

The present invention relates to the field of automotive heat exchangers, and, in particular, to heat exchanger tanks with headers. The present invention further relates to a headering means and a method for providing improved headering means for automotive heat exchangers with plastic tanks and headers, wherein the header inner flange is removed or eliminated.

BACKGROUND OF THE INVENTION

Motor vehicles employ heat exchangers to heat or cool various elements of an automotive engine and its component parts. UK Patent application GB 2166862 A, published May 14, 1986, Gebhard Schwarz, 'Vehicle radiator' discloses a radiator constituted by flat tubes and a single water containing header with separating webs in the flat tubes which extend in prolongation of the separating wall in the water container. U.S. Pat. No. 4,023,618 issued on May 17, 1977, Kun et al, 'Heat exchanger headering arrangement,' discloses a heat exchanger assembly comprising a stacked array of thin-walled heat exchange channel elements. The headering arrangement includes a resilient gasket disposed around the perimeter of each face against the wall portion ends thereof and header tank means enclosing each face of the array and forms a fluid tight seal between the header tank and the stacked array. U.S. Pat. No. 6,179,049 issued Jan. 30, 2001, Higgins, 'Head exchanger with an integrated tank and head sheet,' discloses a heat exchanger having a core of a plurality of cooling tubes with a tank at each end of the core tubes. The tanks are formed with a plurality of cooling tube receiving apertures along a side portion of the tanks which receive the ends of the cooling tubes directly into the tanks and are attached to the tubes by brazing. U.S. Pat. No. 4,183,402 issued Jan. 15, 1980, Cotter, 'Heat exchanger heardering arrangement,' discloses a heat assembly comprising a stacked array of heat exchange channel elements. The improved headering arrangement includes sealing members each having a bearing surface with a generally corrugated contour and header tank means joined to the sealing members so as to leak-tightly enclose the associated face of the stacked array of heat exchange channel elements. Heat exchangers employ heat exchanger tanks which typically include a coolant and require a fluid tight seal. Heat exchanger tanks may be made of a variety of materials, depending on the strength and/or temperature requirements imposed upon them in automotive applications. Plastic tanks have been utilized in heat exchangers and have proven to reduce weight while providing good thermal and strength characteristics in a number of applications. In certain commercial heat exchangers and automotive radiators, it has been common practice to employ a tube sheet headering arrangement.

In such systems, the tubes in the heater core assembly are characteristically forced through corresponding size openings in a sheet member and the latter is then joined to suitable tank or shell means to form a 'header' or header chamber communication with the tubes of the core assembly for introduction or withdrawal of fluid being passed through the tube members.

In certain state of the art designs for automotive heat exchangers with plastic tanks, headers that are stamped from an aluminum sheet are used. In such designs, tube slots are formed with 'ferrules' or 'collars' in the header to accept tubes and to provide a mating surface for brazing the tubes to the header.

As described above, such tank-header arrangements require a fluid tight seal. In order to create such a seal, a depression or trough is formed around the periphery of the header to accommodate the 'edge flange' or 'foot' of the plastic tank; which also serves to retain a header gasket that provides a seal between the tank and header. Correspondingly, the header further includes an oppositely directed 'depression' or 'pan' within the periphery of the outer trough. In certain prior art heat exchangers, the edges of the plastic tank are molded to the turned flange or foot. During construction of the heat exchanger, the tank is installed in the trough, with the tank foot compressing the gasket. The outer edges of the aluminum header are then bent or 'crimped' to capture the edge of the tank foot, thereby joining the tank to the header (See prior art FIG. 1). However, due to the strict requirements imposed upon use of such plastic tanks in automotive applications, and the need to provide fluid tight seals, designs for plastic heat exchanger tanks also use 'flanges' or 'feet' that fit inside the trough formed around the periphery of the header.

In addition, different heat exchanger applications are subjected to different internal pressure and related conditions. Radiators typically have lower operating pressures and temperatures than charge-air-coolers. Radiator tanks can generally be more compact, since the internal fluid is a higher density liquid. Charge air coolers, inter coolers and after coolers typically operate at higher temperatures and pressures, and with more rapid transients than radiators in the same vehicle application. Higher pressures and larger wall surface areas result in greater wall deflection in such applications. Higher temperatures reduce the stiffness and fatigue resistance of the materials. These factors contribute to greater structural integrity and durability problems with more extreme temperatures and pressure conditions.

Reinforcing ribs are also been used on the header of heat exchanger between tube slots (See FIG. 2). Recently a so-called all-aluminum heat exchanger has been invented that provides for brazing of the inner flange of the header to the ends of the tube as an option when utilizing plastic tanks. See US Patent application 2003/0217838A1 published Nov. 27, 2003, Dey et al.

Problems identified in the prior art, therefore, include that of a trough (or well) formed in the periphery of the header tends to increase the overall thickness of the heat exchanger, which can result in packaging problems in the vehicle; and, that of a header width also creates a bending moment, as the offset of the gasket (lower) flange from the header plane generates a second bending moment. These bending moments contribute to stress concentrations in the header when internal pressure is applied. Moving the inner flange inward such that it contacts and is brazed to the tube improve packaging. However, the solution of connecting the inner flange to the thin-walled tube can create stress concentrations in the tube under internal pressure which may exceed acceptable limits in some applications. This, in addition to the problem of internal temperature and pressure conditions in heat exchanger applications, require further solutions not yet found in the prior art.

One response to these conditions has been to provide more rigid tanks and headers for extreme temperature and/or pressure heat exchanger applications. Tank and header deflection and corresponding stresses can lead to failure in the tank wall, in the header, or in the tube-to-header joint area.

Even in a case of radiators, in the initial vacuum coolant filling of radiators in the factory, extreme internal environmental conditions, such a low internal pressure is required that may pull the radiator tank walls and gasket inward, must be resisted by a reinforced feature such as a header inner flange, or the like.

Solutions such as a brazed flange design would achieve similar compactness, but brazing the inner flange to the tube can create stress concentrations in the tube under pressure loading.

Headering means employing mechanical attachment and sealing methods have been developed, due to the difficulty of effectively welding, brazing or soldering of unlike materials (such as alloy headers with plastics such as those found on radiator header tanks). One solution is to provide for an inner flange that encloses a gasket and tank foot, reducing the tendency of the latter to rotate under internal pressure. While this design has been found to be adequate for many radiator applications, it has many disadvantages which are accentuated, as described above, when used in more extreme, and, particularly, internal high temperature and pressure conditions, such as those found in charge air coolers and the like. The present invention has even further advantages as it relates to heat exchangers when fluid flow involves lower density liquids or where operating pressures are greater than moderate or even high to very high.

SUMMARY OF THE PRESENT INVENTION

The present invention provides for headering arrangement for a heat exchanger, and, particularly, a heat exchanger headering arrangement comprising a header part and plastic tank part that forms an adequate seal without the need for a header inner flange. Preferably, the present invention provides for a heat exchanger operating at extreme or higher operating pressures and temperatures, such as those found in charge air coolers, inter coolers, after coolers and the like, wherein the offset between the outer flange and the tube is decreased, reducing bending movements in the header caused by internal pressure loading more preferably in inner flange is utilized. Also, surprisingly, the present invention finds advantages in extreme internal lower pressure conditions, such as radiator applications.

The present invention address and solves problems of the prior art. In preferred embodiments of the present invention the headering arrangement is such that there is no header inner flange. The header inner flange is removed or eliminated. The preferred embodiments of the present invention position inside edges of a tank foot and gasket by the collar that forms the tube ferrule, the collar therefore acting as a 'rib' between header slots to stiffen the header and strengthen or protect the thin-walled tube. In further preferred embodiments, a gasket-mating surface ('gasket' or 'lower flange') is provided coplanar with the header, thus eliminating the header pan.

In preferred embodiments in accordance with the present invention, the design is very compact; only about twice the header thickness (less thinning due to forming), plus the tank foot width, extends beyond the end of the tube on each side. The preferred embodiments, therefore, comprise at least one collar-style tube ferrule acts as a rib, with a resultant 'stiffening' of the header and 'bridging' over the tube-to-header joint or seal to reduce stresses in the thin-walled tube. In preferred methods in accordance with the present invention, embodiments with more rigid headers, the more rigid header designs also have been shown to improve the crimping process.

It is an object of the present invention to provide a headering arrangement whereby there are limited obstructions or restrictions in the gorge space of the header.

It is a further object of the present invention to provide an improved headering means wherein a flat header is formed (the header inner flange is eliminated), and the outer flange, gasket, and gasket sealing surface are moved inward toward the tube. It is a further objective to utilize the collar/tube ferrule for gasket and tank foot location and for reinforcement of the header. Since the header inner flange is eliminated, the total thickness of the header is reduced accordingly. It is further an object of the present invention to provide of making headering arrangement comprising, removing or eliminating the header inner flange; moving the outer flange gasket and gasket sealing surface inward toward the tube; utilizing the collar/tube ferrule for gasket and tank foot location; and, reinforcing the header, thereby minimizing the overall depth of the heat exchanger and reducing structural bending moments by moving the outer header flange inward.

In preferred embodiments of the present invention, the collar/tube ferrule acts as a reinforcing rib, bridging over the critical, i.e. 'fluid tight' tube-to-header joint or seal. In accordance with preferred embodiments of the present invention, and headering arrangement, provides for simplified and compact header designs with improved fabrication characteristics and maximally efficient use of materials, meaning, reduced cost and improved manufacturability, durability and packaging.

In another aspect of the present invention, flat pan headers may be used with inverted collars to produce a similar effect.

In more preferred embodiments, molded heat exchanger tanks are preferably utilized. In its preferred embodiments, the present invention provides for an apparatus and method for reducing induced stresses in heat exchangers, and, in particular, in heat exchanger tanks or collectors, by providing a headering assembly that reduces the width of the header and optimizes the pressure counter-force path. In more preferred embodiments of the present invention, the pressure operating limits of heat exchangers, and, in particular, pressure limits related to the headering means between the heat exchanger core part and the heat exchanger tank part, can thereby be increased while utilizing less material in the headering area.

It is also preferred to provide a sealing means between the header part and the core part of the heat exchanger to ensure that any joint or area of contact remains sealed to the maximum extent possible under the operating pressure limits of the heat exchanger (fluid tight seal). In more preferred embodiments in accordance with the present invention, the sealing means is a 'joint' or 'gasket'; the gasket preferably is used between the heat exchanger header part and heat exchanger body part at the area of contact or seal. More preferred are gaskets that can be cured to maintain their sealing effect. Even more preferred are gaskets that can be cured in place, or cured at the site or area of contact or seal. Also even more preferred are gaskets that can be utilized in both high pressure and lower pressure operating limit environments. Also even more preferred embodiments of the present invention wherein the gasket can be cured in place, and, therefore, utilized in either radiator or higher pressure heat exchanger applications, such as charge air coolers, intercoolers and after coolers, and the like.

In preferred aspects of the present invention, the collar height of the header collars are calculated to maximize correct positioning and alignment of the gasket. Surprisingly, in preferred aspects of the present invention gasket retention is maintained at a high level in both lower and higher pressure environments, such as those found in radiators, charge air coolers and the like, and during engine cooling system fill, i.e, vacuum for better filling, conditions. In the preferred embodiments of the present invention, the correct positioning of the gasket during both assembly and during cycled pressure tests is maintained.

In preferred embodiments of the present invention, the tank design provides for a robust or deflection resistant tank, thereby reducing tube fatigue and fractures, and, in particular, tube fatigue or fractures at or just below the braze joint with the header.

In preferred methods of the present invention, no inner header flange is produced, or, eventually, the inner header flange is eliminated or removed to maintain the flatness of the header during the production processes.

BRIEF DESCRIPTION OF THE DRAWINGS

FIG 3*a-d*. Schematic representation of design for heat exchanger in accordance with an aspect of the present invention, showing a pan with flat medallions (flat plate collector) and inverted collars.

FIGS. 4*a* and 4*b* showing increased overall thickness and bending moments found in prior art designs.

DETAILED DESCRIPTION OF THE PREFERRED EMBODIMENT

The present invention, in its preferred embodiments, overcomes many problems of the prior art. In preferred embodiments, the offset of the outer flange is decreased relative to the tube, thus reducing bending moments on the header due to internal pressure loads on the tank. In the preferred embodiments of the present invention, elimination the offset between the gasket sealing surface or gasket (lower) flange and the header plane eliminates a second bending moment, simplifies the header design, reduces material required, and maximizes ambient airflow to the core.

Elimination of the inner flange and utilization of the tube collar/ferrule 'collar' as a rib structure significantly stiffens the header. Linear FEA of preferred embodiments of the present invention indicates up to about a 40% reduction in stress compared to prior art designs examined. The collar also serves to prevent inward translation of the tank foot during crimping. This can improve durability and the header tab crimping process.

In more preferred embodiment of the present invention, the collar around the tube end radius is revolved and a separation maintained between the tube and the planar area of the header. The collar/rib effectively bridges over the tube, thereby reducing or preventing bending loads in the header from being transmitted to the thin-walled tube. In other preferred embodiments, and, particularly, in radiator applications, gasket retention means on the tank foot may be applied to maintain preferred gasket location and/or placement during vacuum filling.

Figure 1:
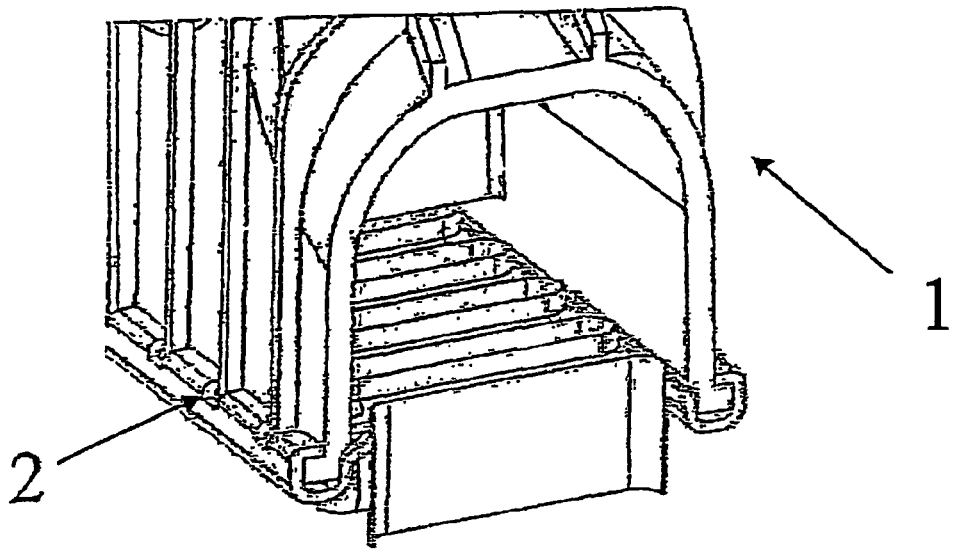
FIG. 1 Prior Art
FIG. 1. Schematic representation of Prior Art design for plastic tank heat exchanger tank and header manifold assembly.
Figure 2:
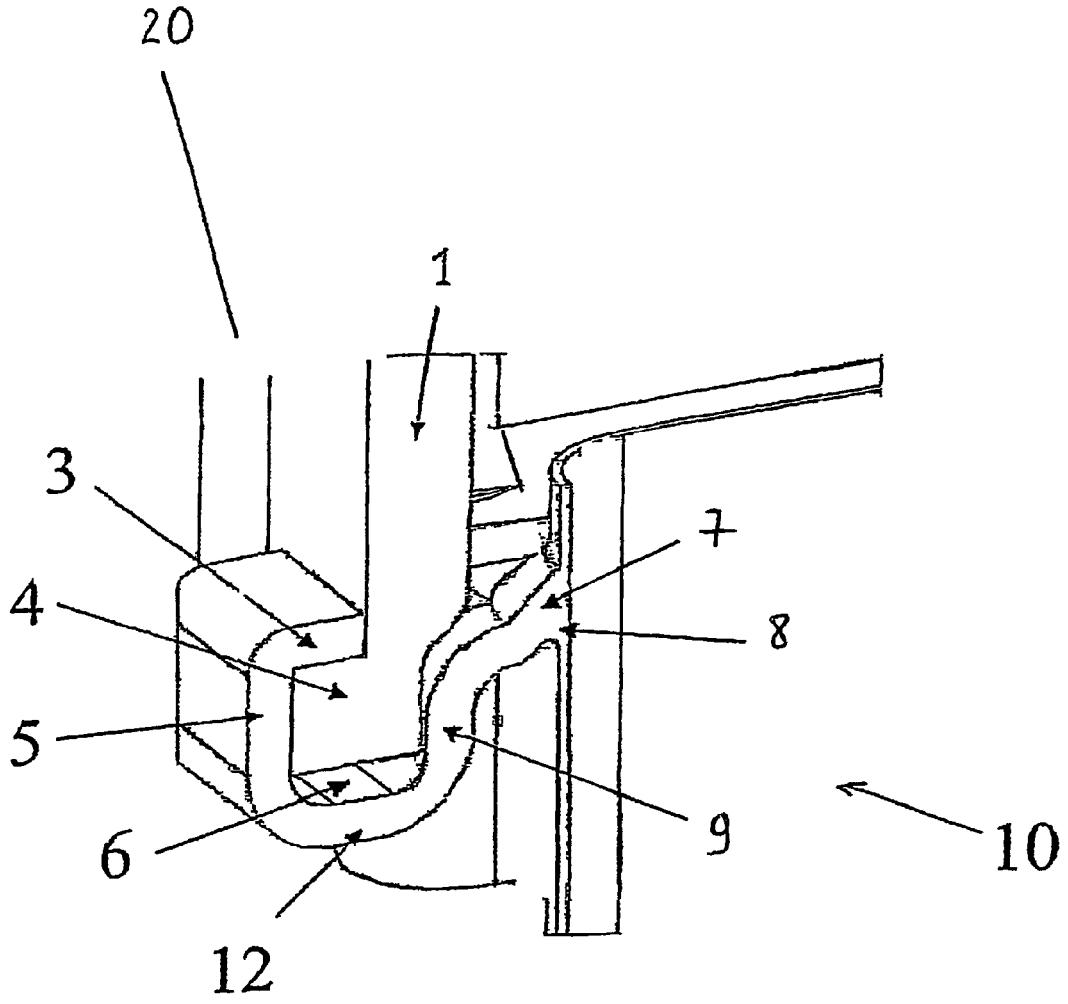
FIG. 2 Prior Art
FIG. 2. Schematic representation of Prior Art design for plastic tank heat exchanger tank and header manifold assembly.

Referring to the prior art shown in FIGS. 1, 2 and 4, therein represented is a plastic tank 1 of a heat exchanger, with header 2. In FIG. 2, tube 10 is brazed at braze joint 8 to a shaved tube ferrule 7 which continues to an inner flange 9 and leads to lower or gasket flange 12 wherein the gasket 6 (not shown) sits. An outer flange 5 extends upwards toward a crimp tab 3 which maintains a tank foot 1 in the tank and header manifold assembly 20. FIGS. 4 *a-c* show the header 2 continuing onto an inner flange 9 and into a lower flange 12, prior to turning upward into outer flange 5 before leading to the tab 11, which, in this depiction, is crimped around the tank foot 4.

In accordance with an aspect of the present invention, FIGS. 3*a*, 3*b*, and 3*c* and FIG. 10 show a schematic representation of a design for a heat exchanger in accordance with an aspect of the present invention, showing a pan 23 with flat medallions 22 (flat plate collector) and inverted collars, the heat exchanger tube 21 ending in a flat plate collector or 'pan' 23 with flat 'medallions' 22 maintaining the tank foot in place, with an intervening gasket 25 in the space between the foot and the pan 23. The pan 23 includes a ferrule (inverted collar shown in FIG. 3*c*) integral to the pan (shown as non-inverted collar 18 in FIG. 9*a* ). As shown in FIG. 3*c*, the tube 21 and the pan 23 together form a type of a gorge 26 wherein the gasket 25 and tank foot 24 are received.

Referring to prior art FIGS. 4 *a, b* and *c*, the depression (trough or header well) formed in the periphery of the header tends to increase the overall thickness 29 of the heat exchanger assembly 20 as shown in prior art FIG. 1. This representation demonstrates the resultant packaging problems for some vehicle applications. The outer header flange 5 offset creates a bending moment arm (L1) 14. A second bending moment arm (L2) 15 exists due to the offset of the gasket (lower) flange 12 from the header plane. When internal pressure is applied, resultant forces (F1, F2) act through these moment arms to generate bending loads. These loads contribute to stress concentrations in the header when internal pressure is applied. Testing, such as that based linear finite element analysis (FEA), shows stress results for preferred embodiments of the present invention that show stress level reductions up to or equal to about 40% lower compared to prior art designs such as described above.

Figure 5:
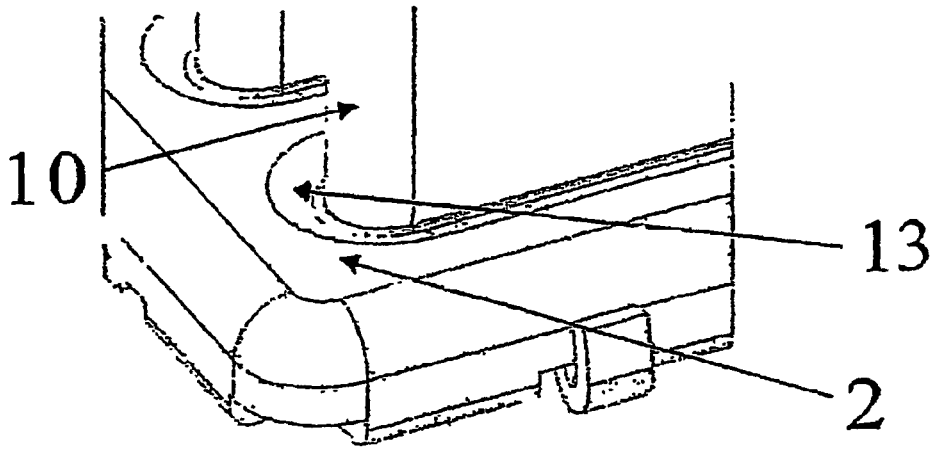
FIG. 5. Schematic elevational representation in accordance with an aspect of the present invention showing flat header where header inner flange not included and offset in gasket flange.
Figure 6:
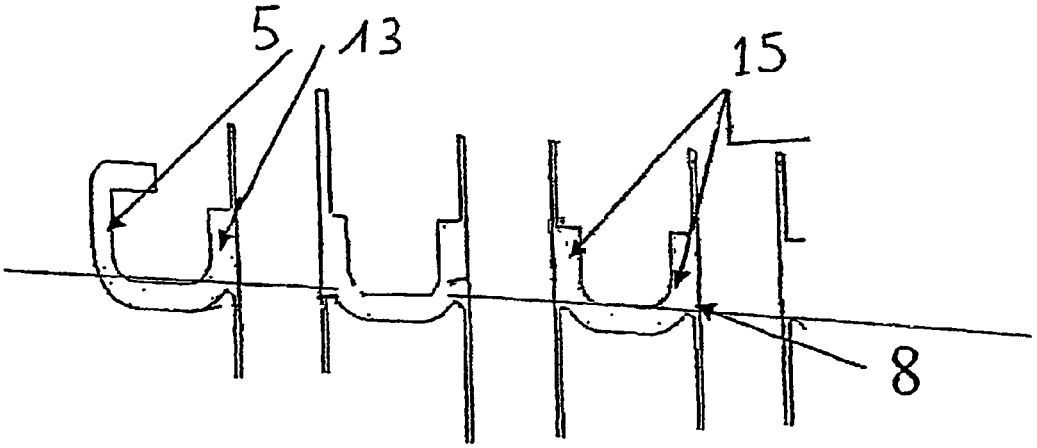
FIG. 6. Schematic cross-sectional representation of collar ribs in accordance with an aspect of the present invention.
Figure 7:
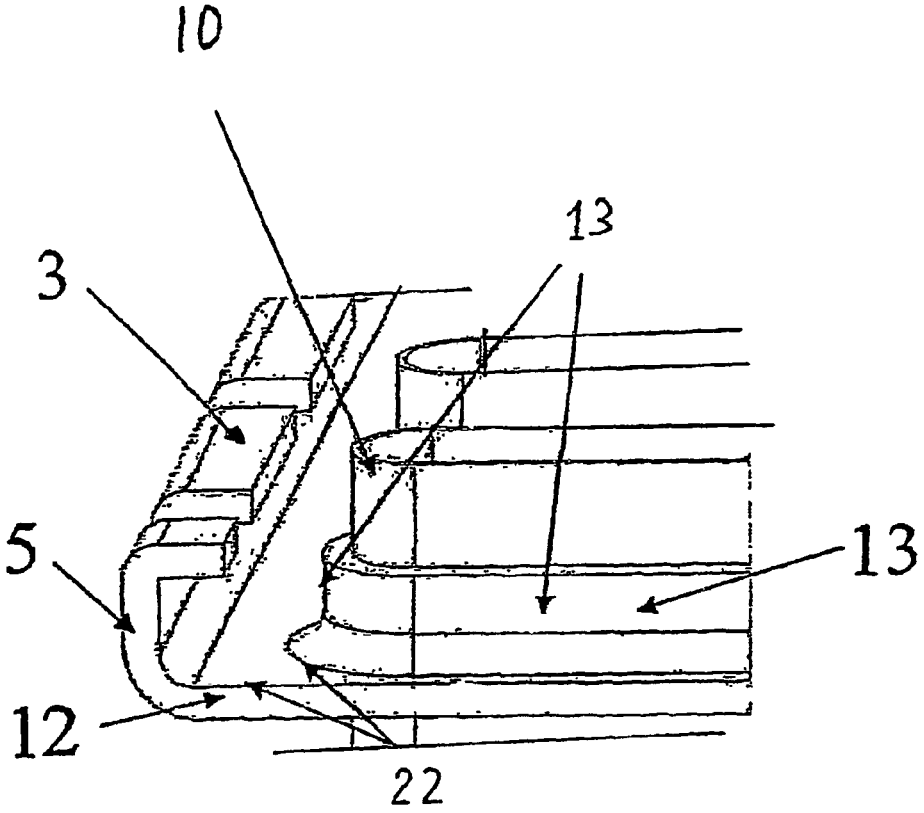
FIG. 7. Schematic representation of collar rib in accordance with an aspect of the present invention FIG. 8. Schematic elevational representation of collar rib in accordance with an aspect of the present invention shows the preferred embodiment of the invention for plastic tank automotive charge-air-cooler applications.

Referring to FIGS. 5, 6 and 7, the outer flange 5 gasket-sealing surface 13 are moved inward toward the tube 10. This tends to reduce the overall thickness of the heat exchanger for improved packaging. The offset between the outer flange 5 and the tube 10 is also decreased, which reduces bending moments in the header caused by internal pressure loading. The planar connection means that the inner flange found in the prior art is eliminated.

Referring to FIGS. 6 and 7, braze point 8 is shown and deeply drawn upturned collars 13 form a U-shaped cross-section or rib 15 between tube slots, significantly increases the bending moment of inertia of the header section. The collar profile, which includes a large radius, is revolved around the end radius of the tube, effectively bridging over and shielding the critical tube-to-header interface. This minimizes the transmission of bending loads to the thin wall of the tube. The height of the formed collar is adjusted, as appropriate, to provide optimized height to performance ratios.

Figure 8:
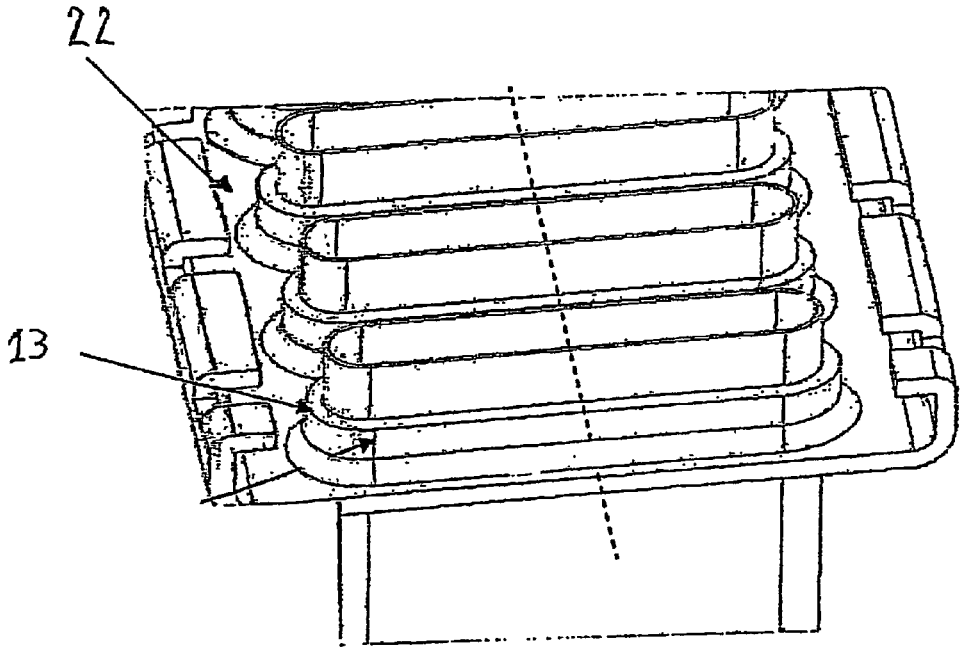

In preferred embodiments of the present invention applying reverse or brazed flange concepts, the elimination of the inner flange for plastic tank applications shows further advantage. Referring to FIGS. 5 and 8, the gasket (lower) flange 12 is made coplanar with the header surface 22 between the tube slots, eliminating the offset of the gasket (lower) flange relative to the header plane.

Figure 9B:
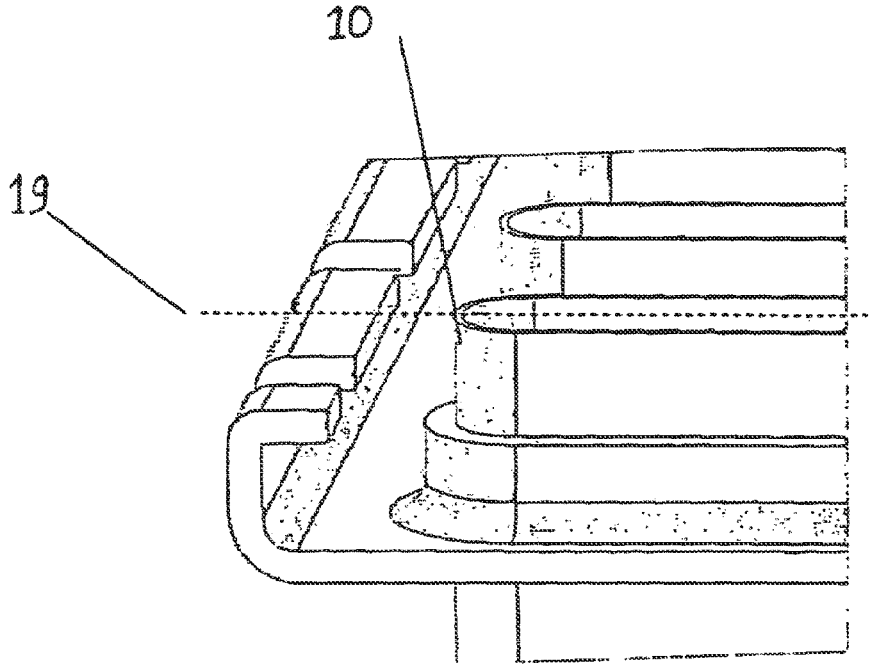
FIGS. 9*a* and 9*b* Schematic elevational representation of collar rib in accordance with an aspect of the present invention showing gasket and tank foot location.
Figure 9A:
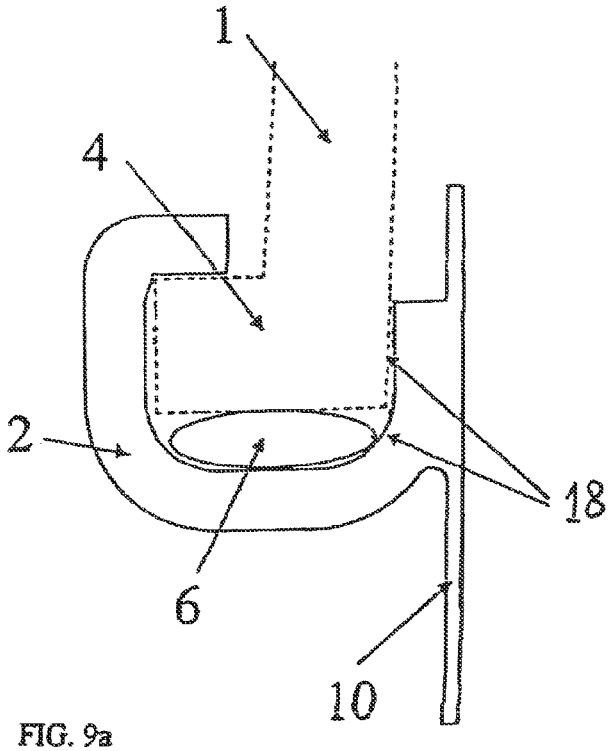

Referring to FIGS. 9*a* and 9*b*, Stresses in the tube-to-header region are significantly reduced for the proposed design compared to the prior art. The collar/rib 10 is relied upon for gasket 6 and tank foot 4 location and retention as well as stiffening the header 2 and providing a clad surface for brazing to the tube 10. Resistance to inward translation of the tank foot by the collar is expected during crimping, which should improve the process. Tank foot 4 and gasket 6 are retained by this collar/rib design.

In one aspect of the present invention the upturned collar of tube ferrule is cladded with braze material on the inside of the collar. By providing inside cladding, an aspect in accordance with the present invention, minimizes the possibility of magnesium diffusion from the sheared surface of the collar from contaminating the braze joint, thereby improving braze quality.

Figure 10:
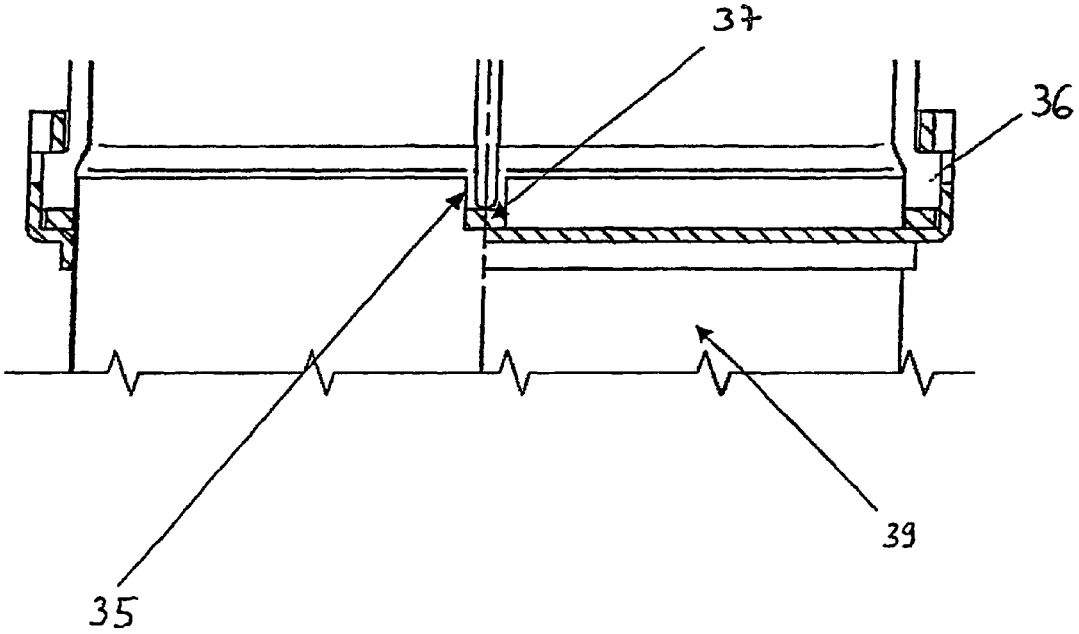
FIG. 10. is a cross sectional view of heat exchanger with inverted collar rib and notch in accordance with an aspect of the present invention.

In a preferred embodiment of the present invention, the heat exchanger of the present invention has an headering arrangement having a heat exchanger body part; a heat exchanger tank part; a header; a tube extending from the heat exchanger body part; a header pan at the end of the tube; a tank foot at the end of the heat exchanger tank part; a gasket; wherein the pan is a flat pan comprising at least one collar. In a more preferred embodiment, the tube extending from the heat exchanger body has a length of less than or about twice the thickness of the header plus the tank foot width of the header. Also, in preferred embodiments, the header pan further comprises at least one flat medallion. Also, in a more preferred embodiment, the gasket is basically flat in shape. As shown in FIG. 10, one particularly preferred embodiment of the present invention, has the at least one collar inverted vis a vis the line of extension of the tube, and preferred embodiments can be used in high or extreme pressure internal operating environments.

In preferred embodiments of the present invention, synthetic resin, plastic or plastic like tanks are you. More preferred are embodiments wherein the synthetic resin, plastic or plastic like materials used in the tanks are used for higher pressure environment applications, such as charge-air-cooler applications and the like. The invention can be applied to any heat exchanger with separate, mechanically assembled (rather than soldered, brazed, welded, or otherwise bonded) tank, gasket, and header components.

In preferred methods of the present invention, no inner header flange is produced, or, eventually, the inner header flange is eliminated or removed to maintain the flatness of the header during the production processes. Particularly preferred are methods employing a stamping step in the process. More particularly preferred methods also involving a brazing step. In the preferred methods of the present invention, the stamping process will employ a stamping tool designed to maintain flatness of the plane of the header, so that the p lane does not become distorted due to residual stamping stress relief. In particularly preferred methods, residual stamping stress relief does not distort the plane of the header during brazing. In particularly preferred methods, a crimping step where the tabs are crimped as described above. Particularly preferred methods wherein the process uses coined or scored 'tabs' to aid in bending or provide an initiation point for bending during the crimping step.

What is claimed is:

1. A headering arrangement for a heat exchanger for use in automotive applications, comprising:
- a heat exchanger body part;
- a plastic heat exchanger tank part;
- a header;
- a plurality of tubes extending from the heat exchanger body part;
- a header pan disposed at an end of the plurality of tubes, wherein the header pan i) includes a plurality of slots for receiving the plurality of tubes, ii) is a flat pan, and iii) defines a plurality of collars, each of the plurality of collars forming a ferrule surrounding and in contact with a respective one of the plurality of tubes;
- a tank foot at the end of the heat exchanger tank part; and
- a gasket;
- wherein:
  - each slot of the plurality of slots is formed with a respective one of the plurality of collars to accept a respective one of the plurality of tubes;
  - the plurality of tubes passes through the plurality of slots, abuts the tank foot, and directly maintains the tank foot in place;
  - the plurality of collars is inverted in relation to a line of extension of the plurality of tubes; and
  - the line of extension is defined by a direction vector that extends away from the respective one of the plurality of tubes, parallel to a central axis of an end segment of the respective one of the plurality of tubes.

2. A headering arrangement for a heat exchanger as in claim 1, wherein the plurality of tubes extending from the heat exchanger body part has a length of: less than twice the thickness of the header plus the tank foot width of the header; or about twice the thickness of the header plus the tank foot width of the header.

3. A headering arrangement for a heat exchanger as in claim 2, wherein the header pan further comprises at least one flat medallion.

4. A headering arrangement for a heat exchanger as in claim 3, wherein the gasket is essentially flat in shape.

5. A headering arrangement for a heat exchanger as in claim 1, wherein the header pan further comprises at least one flat medallion.

6. A headering arrangement for a heat exchanger as in claim 1, wherein the gasket is essentially flat in shape.

7. A headering arrangement for a heat exchanger for use in automotive applications, comprising:
- a heat exchanger body part;
- a plastic heat exchanger tank part;
- a header;
- a plurality of tubes extending from the heat exchanger body part
- a header pan disposed at an end of the plurality of tubes, wherein the header pan i) includes a plurality of slots for receiving the plurality of tubes, ii) is a flat pan, and iii) defines a plurality of collars, each of the plurality of collars forming a ferrule surrounding and in contact with a respective one of the plurality of tubes, and wherein the header pan further includes at least one flat medallion;

a tank foot at the end of the heat exchanger tank part; and a gasket essentially flat in shape;

wherein:

each slot of the plurality of slots is formed with a respective one of the plurality of collars to accept a respective one of the plurality of tubes;

the plurality of tubes passes through the plurality of slots, abuts the tank foot, and directly maintains the tank foot in place;

the plurality of collars is inverted in relation to a line of extension of the plurality of tubes; and the line of extension is defined by a direction vector that extends away from the respective one of the plurality of tubes, parallel to a central axis of an end segment of the respective one of the plurality of tubes.

* * * * *